United States Patent [19]

Freeman

[11] Patent Number: 4,665,956

[45] Date of Patent: May 19, 1987

[54] FLUENT MATERIAL CONTAINER WITH FILLING AND EXHAUST PORTS AND METHOD OF FLLING SAME

[75] Inventor: Bruce E. Freeman, Sheffield, England

[73] Assignee: National Research Development Corporation, London, England

[21] Appl. No.: 815,827

[22] Filed: Jan. 2, 1986

[30] Foreign Application Priority Data

Jan. 11, 1985 [GB] United Kingdom ..... 8500727

[51] Int. Cl.[4] ..... B65B 1/04

[52] U.S. Cl. ..... 141/5; 141/98; 141/231; 406/32

[58] Field of Search ..... 141/1-12, 141/98, 231, 232, 233; 406/32

[56] References Cited

U.S. PATENT DOCUMENTS

| | | | |
|---|---|---|---|
| 2,583,648 | 4/1952 | Hensley et al. | 406/32 |
| 2,783,096 | 2/1957 | Berg | 406/32 |
| 2,805,895 | 9/1957 | Pynor | 406/32 |

FOREIGN PATENT DOCUMENTS

| | | |
|---|---|---|
| 447587 | 5/1936 | United Kingdom . |
| 813625 | 5/1959 | United Kingdom . |
| 921878 | 3/1963 | United Kingdom . |
| 1371238 | 10/1974 | United Kingdom . |
| 2110193 | 6/1983 | United Kingdom . |

*Primary Examiner*—Houston S. Bell, Jr.
*Attorney, Agent, or Firm*—Cushman, Darby & Cushman

[57] ABSTRACT

A container vehicle for fluent contents, that is to say a container in which such contents can be securely held when in transit. It comprises a cylindrical vessel arranged with its axis level and having axially-disposed ports, valve means to prevent an above-axis height load within from spilling out of the ports, and sealed joints halves associated with the ports whereby to make sealed joints between those ports and input and output delivery pipes. The vessel can be rotated by external means and contains at least one helical vane within it which propels contents axially when the vessel is so rotated. The ports may coincide with bearings to support the weight of the vessel. The vehicle may be for the transport of powdered material, to be delivered into and discharged from the vessel when fluidized by pressurized air, in which case angled delivery and discharge spouts within the vessel may suffice as the valve means. Vehicles in containerized form are described, also vehicles suitable for railway travel including variants in which the vessel provides the structural link between bogies at opposite ends of the vehicle. Vessels including discharge means specially suited to liquid contents, and vessels whose weight is supported by bearings, for instance air bearings, remote from the means which rotate the vessel, are also described.

19 Claims, 9 Drawing Figures

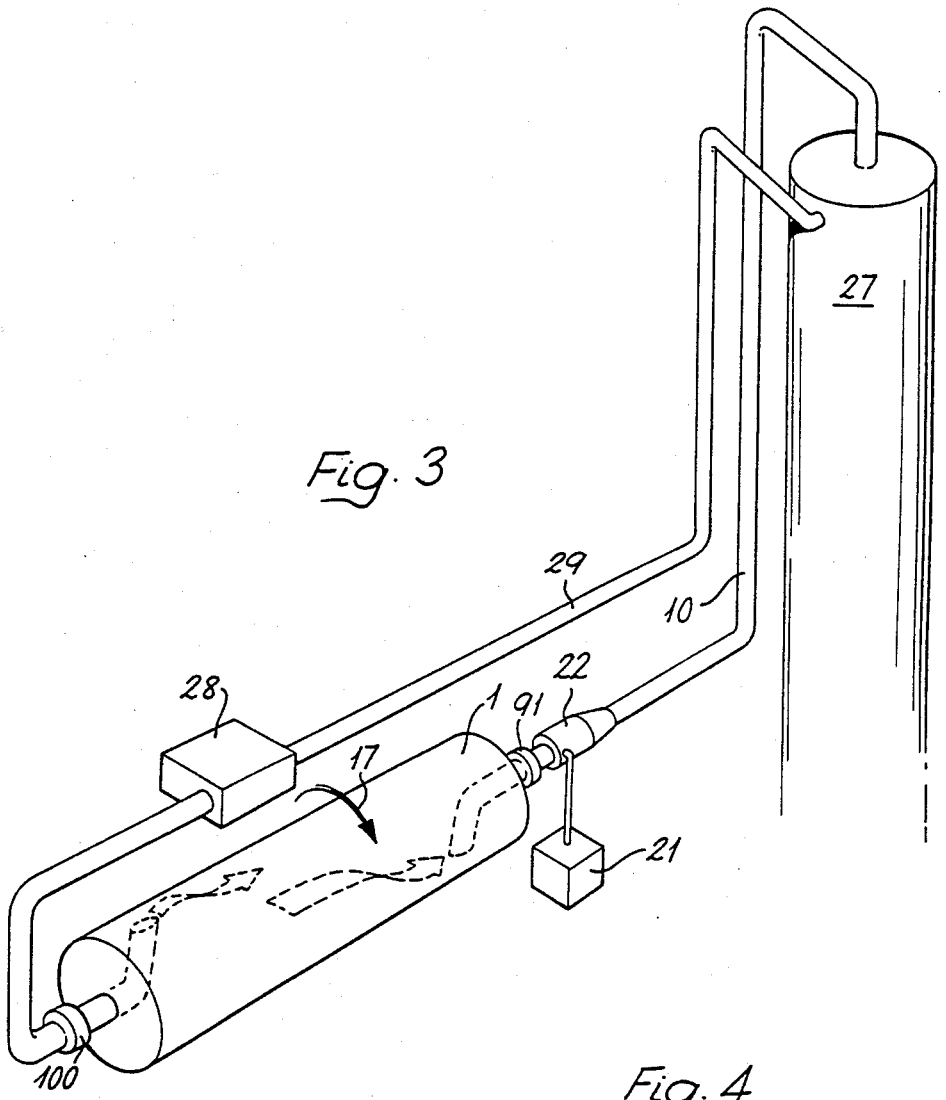
Fig. 3
Fig. 4
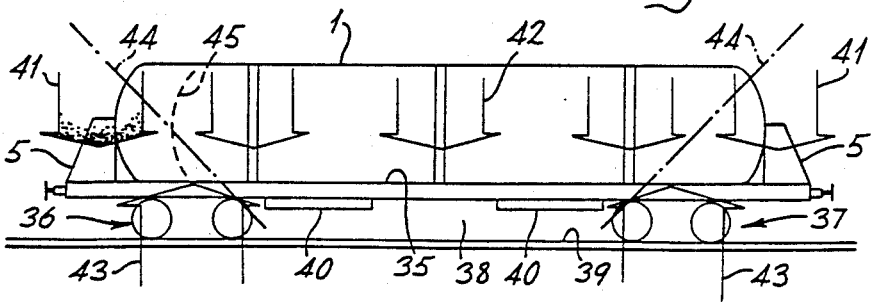

FLUENT MATERIAL CONTAINER WITH FILLING AND EXHAUST PORTS AND METHOD OF FLLING SAME

This invention relates to containers, for instance those containers by which fluent materials such as liquid slurries but especially dry solids such as cement powder are transported, and to methods of loading and unloading such containers. It relates in particular to containers of that kind which are capable of connection to a source of pressurised air or other gas so that the material may be fluidised to improve the rate at which it can be loaded into or discharged from the container.

Many disadvantages can be found in the containers by which materials such as dry cement powder are now commonly transported. Some of these disadvantages will now be described principally with reference to rail vehicles.

Firstly their inlets are commonly located at their highest points. Loading of the container requires it to be driven until it lies vertically beneath the hopper outlet of a silo or other store from which the cement may fall into the inlets by gravity. Inevitable spillage is wasteful and messy, malfunction of the inlet cap or failure to keep it shut except when filling can lead to rain damage of the container contents, and access by staff to inlets at such high level can be hazardous.

Secondly, most known pressure discharge containers of this kind have relied on pressure-aided gravity discharge through one or more hopper-like extensions of inverted-pyramid shape projecting from their undersides, the outlet ports being located in these extensions. These extensions make inefficient use of the volume available in the commonest pressure vessel shape, which is a cylinder mounted with its axis horizontal. Such extensions with their sloping walls have been essential to efficient gravity discharge of the contents in order to avoid the natural tendency of the material to repose and jam. In order to bring the overall height of the vehicle within the necessary limits for railway systems, the hopper outlets have had to be located as low as possible, that is to say beneath the normal platform level of the vehicle, in the space lying horizontally between the forward and rear bogies of the vehicle. Not only has this incurred the disadvantage that the vehicle brakes have to be displaced from this space, which is their most efficient location. Also, because efficient gravity discharge requires that all parts of the cylindrical pressure container must be horizontally close to at least one of the hopper outlets—otherwise jamming is likely, as explained above—such cylindrical containers like the hopper outlets beneath them have had to be concentrated within that part of the vehicle lying *between* the end wheel bogies. The space directly above the bogies has therefore tended to be empty, and wasted, and the load distributed along the chassis of the vehicle has tended to be uneven, given rise to stress concentrations.

One feature of a container according to the present invention is that it is in the form of a cylindrical vessel arranged with its axis horizontal and having internal propeller features that promote the loading and unloading of the vessel by way of axially-disposed inlet and outlet ports when the vessel is rotated. Apparatus showing features generally similar to these is already known—see, for instance, UK Specification Nos. 813625, 921878 and 1371238. However such apparatus are all intended as items of fixed plant, and belong to the arts of mixing and/or liquid/solid contacting. None of them shows a vehicle, that is to say a device whereby material can be transported by land, sea or air, and because of the design of their inlet and outlet none of them is capable of being filled above axis-level with whatever material is to be mixed or otherwise treated. In the field of transport to which the present invention applies, efficiency requires a vessel that is capable of being filled with fluent material and then emptied of it without spillage in either case, of accepting a load that fills it at least to above axis-level, and then of retaining that load securely in transit.

The invention is defined by the claims, the contents of which should be read as part of the disclosure of this specification, and the invention will now be described by way of example with reference to the accompanying diagrammatic drawings in which:

FIG. 3 is schematic and illustrates the unloading of the same container;

FIG. 4 is also schematic and illustrates forces to which the container when part of a wheeled device is subject when loaded;

Figure 1:
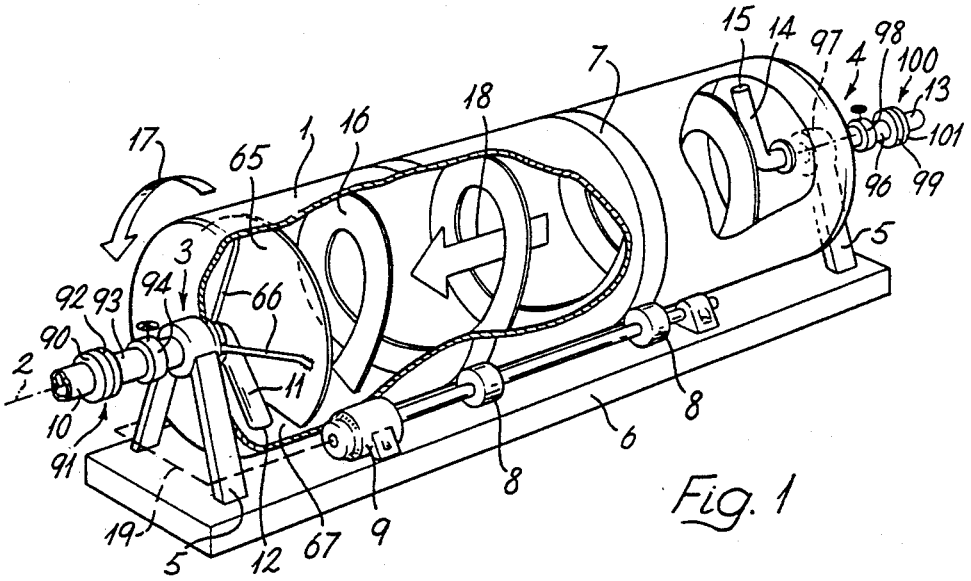
FIG. 1 is a perspective view, partly cut away, of one container.

FIG. 1 shows a container vehicle, that is to say a container in which fluent material can be securely contained during transit. A cylindrical vessel 1 is mounted to rotate about its axis 2 by means of axial bearings 3 and 4 attached to the vessel at opposite ends of its axis, and themselves supported by frames 5 mounted on a platform 6. The vessel is rotated by the frictional engagement of annular rubbing strips 7, mounted on the outer wall of the vessel, with rollers 8 carried on shafts driven by an electric motor 9 mounted on platform 6. Only one such shaft is shown in FIG. 1, but through a connection shown schematically at 19 the motor 9 also drives a second shaft located symmetrically on the far side of vessel 1. The reaction between roller 8 and strips 7 serves also to contribute substantially to supporting the weight of the vessel. A delivery pipe 10, associated with loading/unloading plant to which the container is to be connected, terminates in a joint half 90, which makes a sealed joint (indicated generally at 91) with a corresponding joint half 92 presented by a hollow spigot 93. This spigot, coaxial with axis 2, is a component of a port by which matter can enter or leave the vessel. The spigot 93 contains a valve 94, passes through a rotary seal 95 within bearing 3 and communicates with a non-rotating conduit 11 which slopes downwardly within the vessel and terminates in an open mouth 12. At the other end of the vessel a non-rotating conduit 14, which slopes upwardly within the vessel and terminates in an open mouth 15, communicates with a hollow spigot 96 which passes through a rotary seal 97 within bearing 4 and which contains a valve 98 and terminates in a joint half 99. Spigot 96, which is coaxial with axis 2, is thus a component of a second port by which matter can enter or leave the vessel. Joint half 99 is adapted to make a sealed joint (indicated generally at 100) with a corresponding joint half 101 carried by a second delivery pipe 13 which like the pipe 10 is associated with the loading/unloading plant.

A helical and strip-form vane 16 is mounted on the inner wall of the vessel. When the vessel is rotated by motor 9 in the sense indicated by the arrow 17, it will be apparent that the action of the vane 16 upon any fluent solid matter such as cement or other powder lying with the vessel will be to tend to move it towards the conduit 11, that is to say in the direction indicated by arrow 18. Although a continuous vane running fron one end of the vessel to the other is shown, a succession of shorter helical members all of the same hand would also be practical, provided between them they effectively cover the length of the vessel and so avoid any "dead" spots where matter might tend to accumulate instead of continuing to move towards the conduit 11.

It will be appreciated that as vessel 1 rotates, and the vane 16 propels the powder so that it builds up at the end of the vessel where the non-rotating conduit 11 is situated, in the absence of some protection there is the danger of rapid wear due to the continuous impact between the conduit and the powder as the latter tumbles. A shield 65 which spans the vessel so that it is separated from the inner wall of it by a small annular clearance, and which is attached to the conduit 11 by spokes 66, protects the conduit from such wear. An orifice 67, formed at the lowest point of the shield, allows powder conveyed by the rotating vane 16 adequate access to the mouth 12 of the conduit.

Figure 2:
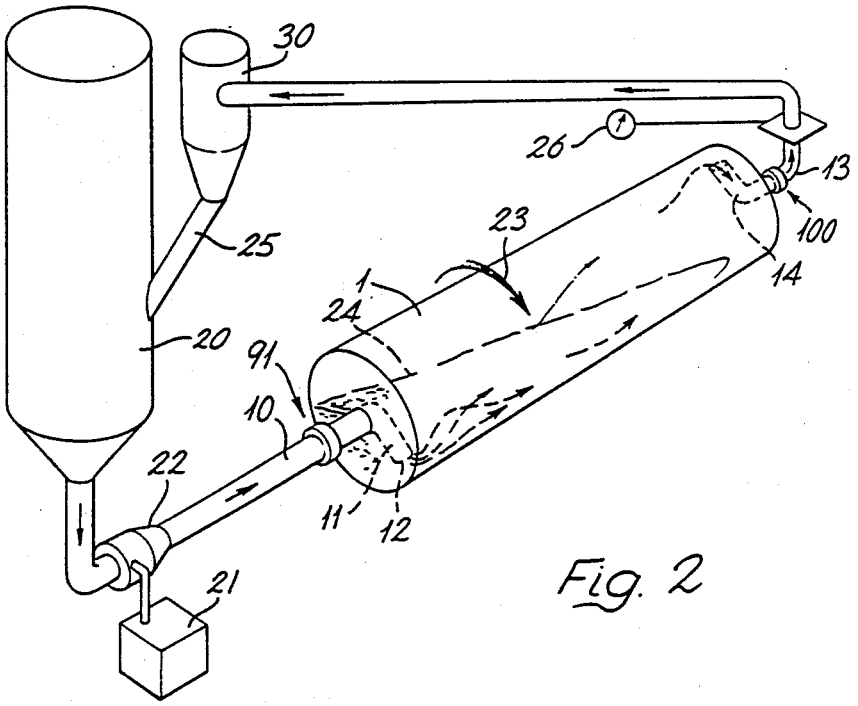
FIG. 2 is schematic and illustrates the process of loading the container of FIG. 1.

FIG. 2 and 3, from which vane 16 is omitted for clarity, illustrate methods according to the invention by which cement or like dry powder may be loaded into and unloaded from the container of FIG. 1. In FIG. 2 the powder is drawn from a silo 20 by the combined effects of gravity and of an injector 22 powdered by an air compressor 21. A fluidised mixture of powder and pressurised air therefore passes along pipe 10 which is connected to spigot 93 by sealed joint 91. Valve 94 in spigot 93 is open, so that the fluidised mixture enters vessel 1 through the mouth 12 of conduit 11. By using motor 9 to rotate the vessel as indicated by arrow 23, that is to say in the opposite sense to arrow 17 of FIG. 1, the vane 16 (not shown) operates to distribute the powder along the entire horizontal length of the vessel, so that it tends to take up the surface profile indicated at 24. Excess air leaves vessel 1 by way of conduit 14. Valve 98 is open and joint 100 is made between spigot 96 and pipe 13, so that the excess air passes by way of pipe 13 to a cyclone filter 30 by which particles of powder remaining in the air are extracted and returned to silo 20 by way of pipe 25, the air itself being discharged to atmosphere. A sensor 26, connected to pipe 13 closely downstream of the vessel 1, may indicate when the concentration of powder within the excess air leaving the vessel reaches a certain level, indicating that the vessel is full.

If at this stage joints 91 and 100 are unmade, so that the vessel 1 is disconnected from pipes 10 and 13 and is thus ready to be transported, then by reason of the angles at which they lie the two conduits 11 and 14 may in practice act as efficient valving means whereby the vessel holds it full load of powder without spillage, even without the closing of valves 94 and 98. However the closure of those valves will positively prevent such spillage, and will of course be necessary where a more fluent load—for instance a liquid or a slurry—is to be contained and transported.

In the corresponding unloading process, illustrated in FIG. 3, with joints 91 and 100 made and with valves 94 and 98 open, motor 9 is reversed to rotate the vessel in the direction of arrow 17 again, injector 21 is reversed to suck powder from vessel 1 by way of conduit 11, and pipe 10 is extended to raise and deliver the extracted material to the top of a storage silo 27. Discharge is aided by connecting a compressor 29 into pipe 13 to deliver air at pressure—say 30 lb/sq in—into the vessel by way of conduit 14 so that what leaves the vessel is a fluidised mixture of powder and pressurised air. Like the pipe 10, the inlet pipe 29 to compressor 28 is also connected to silo 27, so as to help maintain ambient pressure within it, and maintain a closed circuit to avoid cargo contamination and environmental pollution.

FIG. 4 shows in outline the vessel 1 of FIGS. 1 to 3 as part of a rail vehicle, being mounted on a platform 35 supported at opposite ends on rail wheel bogies 36 and 37. Certain details should be specially noted. Firstly that the space 38 which lies horizontally betwen the two bogies 36 and 37, and vertically between the rails 39 and the platform 35, is now unobstructed by any part of the container and therefore free to house the brake units 40 at their most efficient location. Secondly the considerable horizontal overlap between the two axial ends of the vessel 1 and the bogies 36 and 37 respectively; this promotes a pattern of load forces and support forces indicates schematically by the downward arrows 41, 42 and the upward arrows 43 respectively, and the fact that the outermost downward loads 41 lie horizontally outboard of the upward forces 43 tends to avoid the planes of weakness (indicated in broken lines at 44) which tend to exist in conventional designs where efficient low level discharge under gravity requires the ends of the vessel to be located more inboard, for instance as indicated in broken lines at 45. The space required for the frames 5 in the vehicle of FIG. 4 may nevertheless be quite sufficient to offer safe working accommodation for staff attending to bearings 3 and 4 and the rotary joints associated with them, and the height of these joints above the platform 35 (equal only to about the radius of vessel 1) may well be such that staff standing on the platform can reach them without the need for long ladders.

Figure 5:
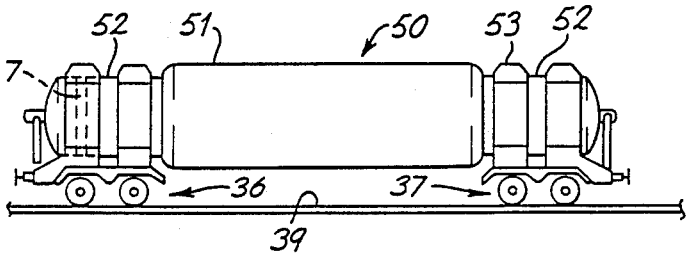
FIG. 5 is an elevation of a wheeled vehicle including a modified container.

In the modified vehicle of FIG. 5 the platform 35 is missing and the cylindrical container 50, which comprises a central length 51 and ends 52 slightly smaller in diameter, itself provides the structure for the body of the vehicle. The rubbing tracks 7 (of which one only is indicated) are mounted on the ends 52, and lie within circular collars 53 mounted on the bogies 36, 37. Such a container is rotated by the reaction against tracks 7 of driven rollers as before; these rollers and the motors to drive them are not shown, but the rollers will be mounted within the collars 53 and driven by motors mounted on the bogies 36 and 37.

Figure 6:
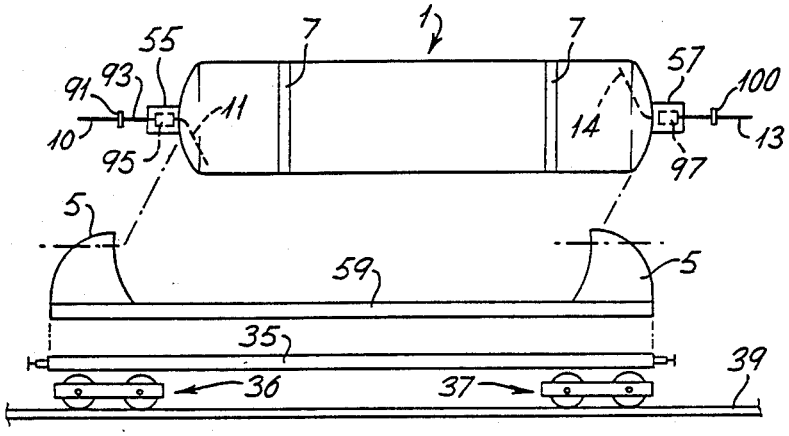
FIG. 6 is an exploded elevation of another wheeled vehicle.

FIG. 6 illustrates the potential ease of maintenance of a vehicle as shown, for instance, in FIG. 4. A stub axle 55 projects from one end of the vessel 1 and contains the rotary seal 95 by which downward conduit 11 within the vessel is connected to spigot 93. This spigot as before contains valve 94 and terminates in joint half 92. A coaxial stub axle 57 projects from the other end and contains the rotary seal 97 connecting the upward conduit 14 to spigot 96, which contains valve 98 and terminates in joint half 99 as before. The stub axles 55 and 57 of course constitute the inner members of end bearings 3 and 4 and this Figure illustrates the ease by which, when bearings 3 and 4 are opened, the entire vessel 1 complete with axles 55 and 57 may be removed from the frames 5 and the rest of the vehicle for maintenance. The Figure also indicates how the frames 5 could be mounted, not on the vehicle platform 35 itself, but on an intermediate base 49, so that this base together with the vessel 1 could constitute the entire essential structure of a container according to the invention and be capable of being transported on an ordinary rail platform vehicle (comprising the platform 35 and the bogies 36 and 37), the vehicle itself requiring no modification for the purpose.

Figure 7:
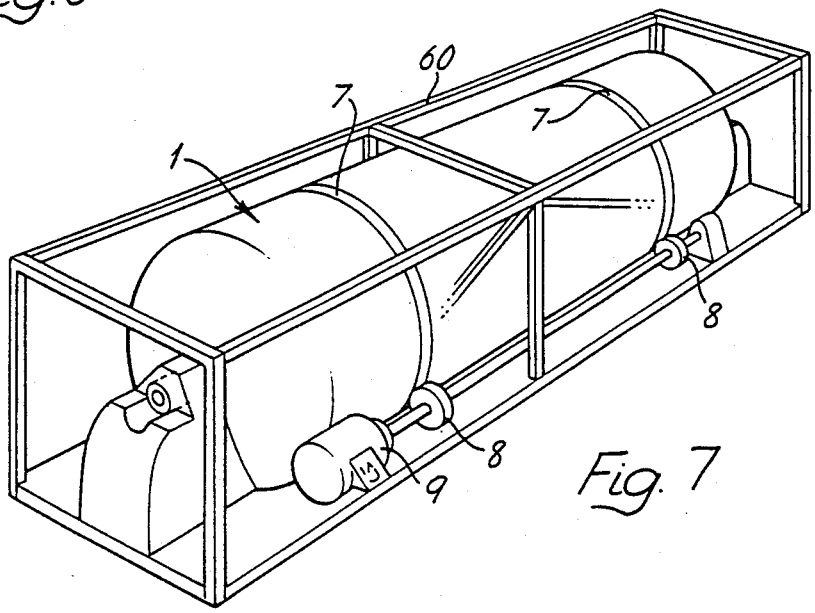
FIG. 7 shows another container in perspective.

FIG. 7 shows a vessel 1 and associated parts, including in particular the motor 9, "containerised" by being mounted within a frame 60 of the kind now commonly used for container traffic of goods by both road and rail.

Figure 8:
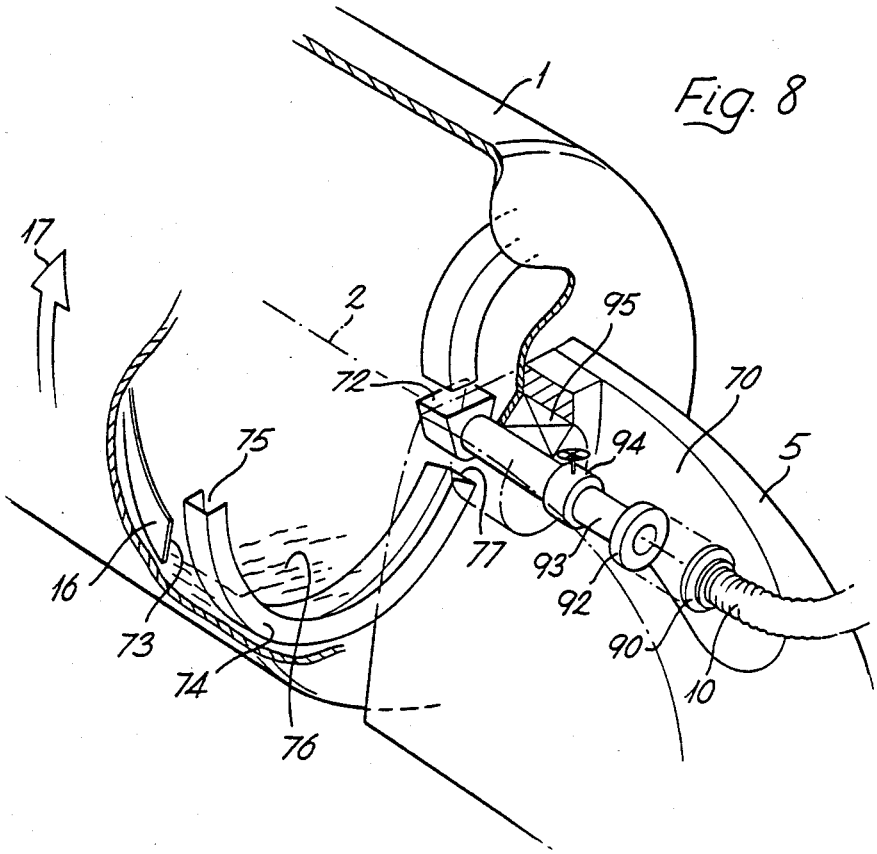
FIG. 8 is a perspective and cut-away view of the outlet end of another container.

The versions of the invention hitherto described, and in particular such details as the downward-sloping outlet conduit 11 and its protecting shield 65, have been particularly suitable for use in vessels for the transport of powders to be loaded and unloaded with the aid of compressed gas. However as already stated the invention also applies to containers for fluent materials of other types, for instance wet slurries, upon which the action of a rotating vane such as item 16 may have a beneficial mixing as well as a conveying effect. The modified form of output system for the vessel 1, as illustrated in FIG. 8, may be particularly suitable for such materials. Here the bearing 3 is supported by a frame 5 of modified shape, including a channel 70 allowing easy address of the joint half 90, presented by delivery pipe 10, to the corresponding half 92 presented by spigot 93. This spigot contains a valve 94 and passes through a sealed rotary bearing 95 as before, but now a trough 72 is attached to the spigot immediately inside the vessel, so that the trough and pipe 10 remain stationary while the vessel 1 rotates. The free end of a spiral vane 16 is indicated at 73, shield 65 and conduit 11 are no longer present, and in their place a succession of channel-sectioned scoops 74 (of which two are shown) are mounted on the end wall of the vessel, at regular angular intervals relative to the vessel axis 2. When the vessel is rotated in the direction of arrow 17, it will be apparent that once per revolution the radially-outer end 75 of each scoop 74 digs into the mass of material 76 within the vessel. As the vessel then continues to rotate, the material picked up by the scoop passes radially inwards down its channel-section until it falls by gravity out of the opposite end 77 and into trough 72. If it is necessary to help promote the transfer of the material from the trough 72 through the sealed bearing 95 into pipe 10, means (not shown) may be provided for instance to agitate the trough, or to aerate the material that it has received.

Figure 9:
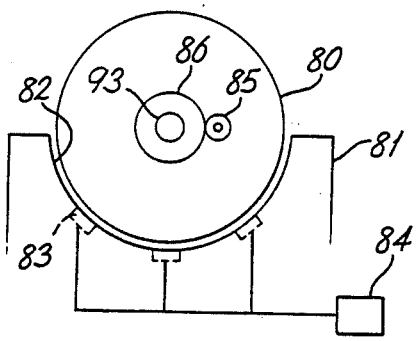
FIG. 9 is an end elevation of yet another container.

With all the container vehicles described so far, with reference to FIGS. 1 to 8 of the drawings, all or at least part of the weight of the container has at least been capable of being borne by the axial bearings about which the container also rotates. The container 80 shown in outline in FIG. 9 is different not only in that it rotates within air bearings (of which one is shown) comprising cradles 81 presenting semi-circular faces 82 which confront the circumference of the vessel and contain bearing recesses 83 connected to a pressure air source 84. The container of this Figure differs from the others also in that the air bearings support the whole of the weight of the vessel. The rotary drive is imparted to the vessel by the engagement of a cog 85, driven by means not shown, with a larger gear 86 mounted on the vessel end, and this engagement supports none of the vessel weight. Reference 93, as before, indicates one of the spigots, which now passes through gear 86.

In all the examples of the invention described so far the two ports, by which material can enter or leave the vessel, have been located at opposite ends of it. In certain cases they could alternatively be arranged as a coaxial pair, both at the same end of the vessel and one within the other, the spigot of one being connected for instance to a downwardly-sloping conduit such as 11 and the other to an upwardly-sloping one such as 14.

In all the examples (those of FIGS. 1, 2, 3 and 8) in which the interior of the vessel has been described, helical members (e.g. the vane 16) of a single hand have been shown, the action of which has been either to fill an entire container from one end or to discharge it from one end. A possible alternative arrangement would be to have members of one hand mounted on the inner wall of the vessel between the mid-length and one end, and members of the opposite hand between the mid-length and the other end. This arrangement could make it possible to fill an empty vessel by connecting both ends to a source of material and rotating the vessel in one sense, and to empty a full vessel by rotating it in the opposite sense and connecting both ends to a point of discharge. Such an arrangement could in practice require a single port at one end of the vessel and a pair of coaxial ports, one within the other, making three ports for the vessel in all. One of the coaxial pair could then serve to allow air to leave or enter the vessel as solid material enters or leaves through the two remaining ports.

I claim:

1. A container vehicle for fluent material, that is to say a container capable of containing said fluent material securely in transit, comprising:

a cylindrical vessel presenting an axis and adapted to be mounted with said axis horiziontal and having at least first and second axially-disposed ports by means of which matter may leave said vessel through said first port as other matter simultaneously enters by said second;

first and second valve means associated with said first and second ports, operation of said first and second valve means enables said vessel to retain a load of said fluent material filling it to above the level of said axis;

first and second sealed joint halves associated with said first and second ports respectively, whereby sealed joints may be made connecting said first port to means to receive said matter leaving said vessel and connecting said second port to means by which other said matter simultaneously enters said vessel;

a source of drive;

driving means attached and exterior to said vessel, engagement of which by said source of drive will rotate said vessel about said axis;

at least one helical vane within, coaxial with and fixed to said vessel, whereby as said vessel is rotated said vane tends to drive any said fluent material contained within said vessel in a direction parallel to said axis.

2. A container vehicle according to claim 1 in which said first and second ports are located at axially-opposite ends of said vessel.

3. A container vehicle according to claim 2 having axial bearings for supporting at least part of the weight of said vessel, and in which said first and second ports coincide with said axial bearings.

4. A container vehicle according to claim 1 in which said driving means comprises at least one circumferential band of toothed form, presented by the exterior of said vessel and suitable for engagement with a positive said source of drive.

5. A container vehicle according to claim 1 in which said driving means comprises at least one circumferential band on the exterior of said cylindrical vessel, suitable for engagement with a frictional said source of drive such as a driven roller.

6. A container vehicle according to claim 1 in which said driving means is a gear coaxial with and mounted on one end of said vessel.

7. A container vehicle according to claim 6 comprising in addition bearings which engage with the cylindrical wall of said vessel so as to support its weight as it rotates, the engagement of driving means with said source of drive itself supporting substantially none of that weight.

8. A container vehicle according to claim 1 including, within said vessel, a downwardly-sloping conduit connectable to said first port and capable of remaining still while said vessel rotates, whereby as said vessel rotates the mouth of said conduit may remain close to the lowest point of said vessel to receive said outgoing fluent material.

9. A container vehicle according to claim 8 in which a baffle, spanning the interior of said vessel, shields at least part of said sloping conduit from contact with the contained said fluent material as the latter tumbles when said vessel rotates.

10. A container vehicle according to claim 1 in which scoop-like members are provided, associated with the inner wall of said vessel adjacent to said first or outlet axially-disposed port, and are adapted to gather and raise said fluent material from the floor of said vessel towards said axis as said vessel rotates.

11. A container vehicle according to claim 10 including a receptacle attached to said the outlet port, within said vessel, to receive said fluent material raised by said scoops.

12. A container vehicle according to claim 1, when mounted within a frame of container, pallet or like type, said frame including also said source of drive to rotate said vessel by engagement with said driving means.

13. A wheeled device carrying both a container vehicle according to claim 1 and said source of drive.

14. Wheeled device according to claim 13 including a load-bearing chassis, at least two axles spaced apart and supporting said chassis, and in which the length of said vessel is such that it substantially exceeds the said spacing-apart between said axles and thus substantially overlaps both of them horizontally.

15. Wheeled device according to claim 14 in which said vessel is attached to said two spaced-apart axles at its opposite ends and itself serves as the structural member of said device by which said two axles are linked to each other.

16. A method of filling a container vehicle of the type having a cylindrical vessel presenting an axis and adapted to be mounted with said axis horizontal and having at least first and second axial-disposed ports by means of which matter may leave said vessel through said first port as matter simultaneously enters by said second port, first and second valve means associated with said first and second ports; first and second sealed joint halves associated with said first and second ports respectively, whereby sealed joints may be made connecting said first port to means to receive said matter leaving said vessel and connecting said second port to means by which other said matter simultaneously enters said vessel, a source of drive, driving means attached and exterior to said vessel, engagement of which by said source of drive will rotate said vessel about said axis, and at least one helical vane within, coaxial with and fixed to said vessel, whereby as said vessel is rotated said vane tends to drive any said fluent material contained within said vessel in a direction parallel to said axis, said method comprising the steps of passing solid materials such as cement powder from a source to said vessel while fluidizing the material with pressurized gas, the introduction into said vessel being through one of said first and second ports and while effecting rotation of said vessel about said axis and while exhausting excess air from said vessel by the other of said ports and passing said exhaust air to a filter by which solid material is separated from the exhaust gas.

17. A method according to claim 16 in which said solid material removed by said filter is returned to said supply from which said solid material is being drawn.

18. A method of filling a container vehicle of the type having a cylindrical vessel presenting an axis and adapted to be mounted with said axis horizontal and having at least first and second axial-disposed ports by means of which matter may leave said vessel through said first port as matter simultaneously enters by said second port, first and second valve means associated with said first and second ports; first and second sealed joint halves associated with said first and second ports respectively, whereby sealed joints may be made connecting said first port to means to receive said matter having said vessel and connecting said second port to means by which other said matter simultaneously enters said vessel, a source of drive, driving means attached and exterior to said vessel, engagement of which by said source of drive will rotate said vessel about said axis, and at least one helical vane within, coaxial with and fixed to said vessel, whereby as said vessel is rotated said vane tends to drive any said fluent material contained within said vessel in a direction parallel to said axis, said method comprising the steps of rotating said vessel so that said helical vane tends to drive said material towards said first port, supplying pressurized gas to said second port, withdrawing material fluidized by said gas from said vessel through said first port and passing said material into a delivery pipe.

19. A method of unloading a container vehicle according to claim 18 enhanced by applying suction by venturi to said delivery pipe.

* * * * *